United States Patent [19]

Higdon

[11] Patent Number: 4,788,826

[45] Date of Patent: Dec. 6, 1988

[54] METHOD AND APPARATUS FOR PREVENTING FLOODBACK IN COOLING APPARATUS

[76] Inventor: Scott Higdon, 5409 Morningside Dr., Yakima, Wash. 98901

[21] Appl. No.: 34,427

[22] Filed: Apr. 3, 1987

Related U.S. Application Data

[63] Continuation-in-part of Ser. No. 927,323, Nov. 4, 1986, abandoned.

[51] Int. Cl.[4] ..... F25B 41/00

[52] U.S. Cl. ..... 62/126; 62/212

[58] Field of Search ..... 62/227, 224, 225, 212, 62/126, 209; 236/78 B, 91 F, 91 G, 78 C; 374/114

[56] References Cited

U.S. PATENT DOCUMENTS

| | | | |
|---|---|---|---|
| 3,165,681 | 1/1965 | Pinckaers | 236/78 C |
| 3,577,743 | 5/1971 | Long | 62/225 X |
| 3,913,347 | 10/1975 | Stevens | 62/209 |
| 4,116,219 | 9/1978 | Nurnberg | 236/91 F |
| 4,136,822 | 1/1979 | Felter | 236/91.6 |
| 4,677,830 | 7/1987 | Sumikawa et al. | 62/126 |

OTHER PUBLICATIONS

Modern Dictionary of Electronics, Graf, 1972, p 139.

*Primary Examiner*—William E. Wayner
*Attorney, Agent, or Firm*—Don R. Mollick

[57] ABSTRACT

A method and apparatus for preventing flood back in refrigeration systems which include a compressor, expansion valve and evaporator coil, by sensing the temperature differential across the evaporator coil and deactivating the compressor when the differential exceeds in the negative direction a predetermined amount of superheat. A second embodiment uses the sensing to operate flooded systems at peak efficiency at or near 0 superheat. A third embodiment uses all electronic circuitry to operate the system.

1 Claim, 4 Drawing Sheets

METHOD AND APPARATUS FOR PREVENTING FLOODBACK IN COOLING APPARATUS

This application is a continuation-in-part of Ser. No. 927,323 filed 11/4/86, now abandoned.

FIELD OF INVENTION

This invention pertains to two types of cooling apparatus; (1) (DX) Freon evaporative coil and (2) Phillips ammonia evaporative coil (flooded system). The DX Freon cooling apparatus is one in which a fluid is allowed to vaporize and expand in an evaporator coil to cool an area. The flooded system is one in which ammonia is the working fluid and remains in a iquid state through the evaporator coil.

BACKGROUNG OF INVENTION

Two common types of systems are in use in the controlled atmosphere refrigeration industry. The first, direct expansion type commonly uses Freon, a Dupont trademark, as a working fluid. Freon describes a family of compounds which are flouro and flurohalo hydrocarbons.

In a DX cooling system a Freon liquid is allowed to vaporize and the resulting vapor expands in an evaporator coil. This method is commonly used in the refrigeration and air conditioning industries. The particular Freon compound is chosen for a desired temperature range. The major components of such a system are a compressor, an expansion valve and an evaporator coil along with associated plumbing. Vaporized freon enters the compressor from the outlet of the evaporation coil. The compressor compresses the gas to a point where it becomes a liquid. The liquid is conveyed from the compressor to the expansion valve. At the expansion valve the liquid is allowed to expand and vaporize. The expansion valve opens into the inlet of the evaporator coil. Vaporization and expansion continue through the evaporator coil. The vaporization and expansion of the Freon absorbs heat. Fans may be located to blow air through the coil which is thereby cooled. The fully vaporized Freon then exits the evaporator coil and returns to the compressor for another cycle.

A problem has arisen with this type of apparatus which we will refer to as floodback. Under certain conditions liquid freon collects at the exit of the evaporator coil. When this condition occurs the liquid freon is sucked into the compressor. The liquid freon at the compressor inlet can result in destruction or severe damage to the compressor. In large systems the damage to the compressor may be several thousand dollars. In addition, the liquid freon displaces lubricating oil from the compressor which is relocated into the rest of the system. Cleaning the oil out of the system adds several hundred dollars to the repair bill. One method of preventing this problem is to run a system well below capacity. Prior attempts to sense this flooding condition have been electronic and cost several thousand dollars and have not met with commercial success. Accordingly, there is a need for a cost effective method and apparatus for sensing flood back and preventing damage to the system.

The ammonia system in general use is the so called "Phillips" or ammonia flooded coil configuration. In this type of system the working fluid is ammonia. The same components are present except that there is no need to diffuse vapor to the coil. The coil is continuously flooded with liquid ammonia. In the ammonia flooded coil configuration it would be useful to know at which point the coil is at or near a saturated state. The degree of saturation relates to the efficiency of the system. At present there is no commercially practicable system for determining the degree of saturation in an ammonia flooded coil system. Accordingly, there is a need for an apparatus to determine the degree of saturation in such a system.

SUMMARY OF THE INVENTION

The invention provides an inexpensive method and apparatus for detecting floodback conditions in Freon systems. In addition, the invention provides a method for determining the degree of saturation in ammonia flooded coil systems. This invention is equally applicable to computer controlled and electro mechanical systems. Such systems may be either fully automatic or may alert an operator to the condition.

The invention includes temperature sensors at the inlet and outlet of the coil. The sensors are connected to a unique differential thermostat actuator which allows compensation for ambient temperature variances. The actuator may actuate a switch connected to an alarm or directly to the compressor. Alternately, the actuator can provide a analog output acceptable to computer operated systems. The device is not intended to replace thermal expansion valves but to supervise their operation.

An additional embodiment is illustrated which utilizes electronic circuits to achieve the same end.

DETAILED DESCRIPTION OF THE DRAWINGS

Figure 1:
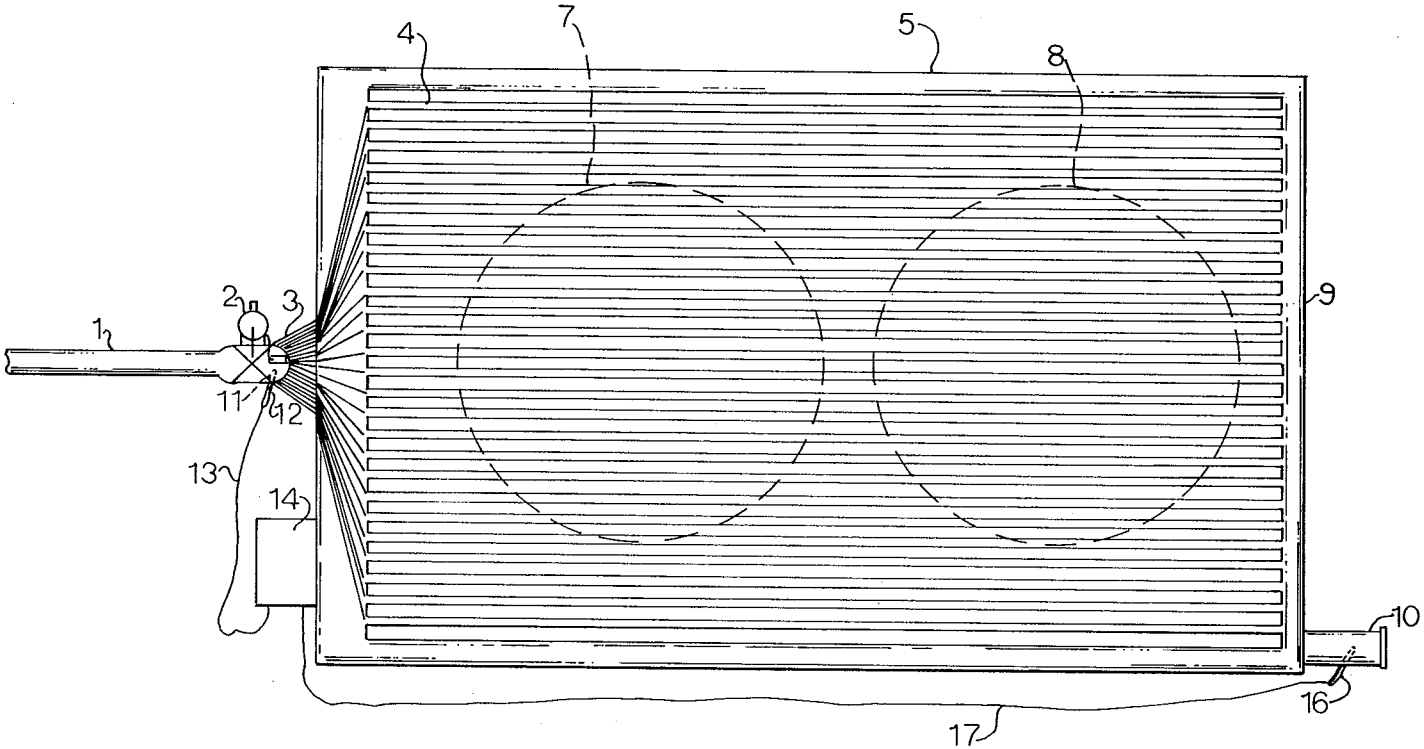
FIG. 1 is a front elevation view of the invention.

FIG. 1 is a front elevation view of the invention's application for DX Freon. The invention is installed in a conventional freon evaporative system. Liquid freon enters via an inlet 1 from the compressor (not shown). The compressor is chosen for size by conventional standards known to a person of average skill in the art. The inlet is connected to an expansion valve 2. Expansion valve 2 is standard in the refrigeration art and is shown by conventional symbolsion. At expansion valve 2 the freon begins to vaporize. A distributor 3 is connected to the outlet end of expansion valve 2. Distributor 3 conveys vaporizing freon to individual tubes 4 of the evaporator coil 5. Distributor 3 is found in evaporative systems but not in flooded systems. The primary evaporation and vaporization of freon takes place in tubes 4 of evaporator coil 5. The vaporization of the freon results in rapid cooling of coil 5. Fans 7,8 are positioned behind evaporator coil 5 to blow air around the individual tubes 4. Under normal operation evaporation of freon is complete when the freon reaches manifold 9. The vaporized freon exits at outlet 10 connected to manifold 9 and returns to the compressor (not shown) for another cycle. A flooded condition occurs when evaporation is not complete in evaporator coil resulting in liquid freon at outlet 10.

A well 11 is located in the outlet of expansion valve 2. A sensor 12 is in well 11. Sensor 12 is a fluid filled bulb or equivalent capable of measuring the temperature present in well 11. Sensor 12 may simply be a closed end of a capillary 13. Sensor 12 is connected via capillary 13 to a control box 14. A second sensor 16 is connected to control box 14 via a second conduit 17. Sensor 16 is located in a second well 18 located in the outlet 10 of the evaporator coil 5. Sensor 16, in conjunction with sensor 12 and control box 14, is capable of measuring the temperature differential between expansion valve 12 and outlet 10. When a flooded condition ( i.e. less superheat) occurs the temperature differential between expansion valve 2 and outlet 10 changes. This change is immediately sensed by control box 14 which either cuts off power to the compressor (not shown) or activates an alarm to alert the operator. Because flood back can be detected as soon as it occurs the coil may be run at a higher capacity which can be as much as a 50% increase in coil tonnage, but typically is 15 to 35%.

Figure 2:
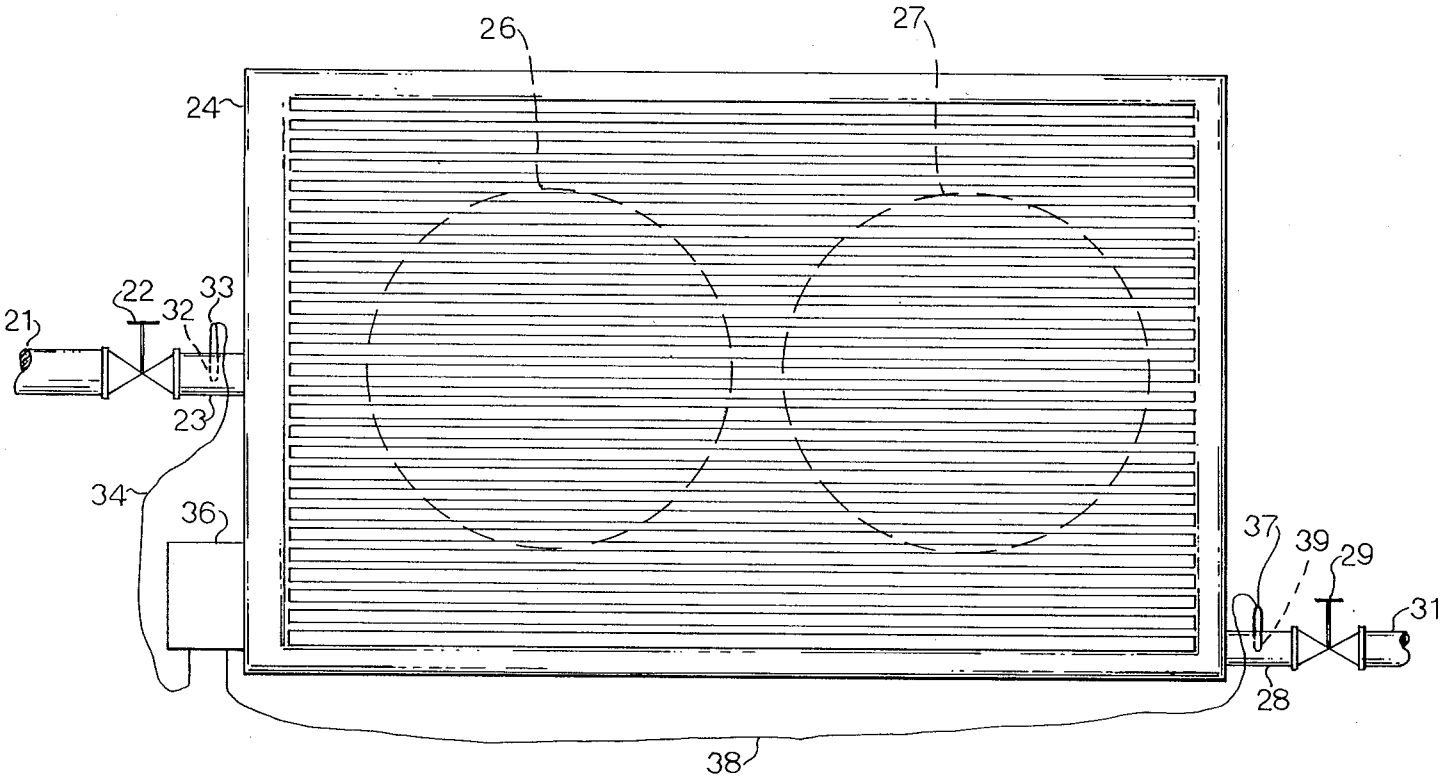
FIG. 2 is a front elevation view of a second embodiment of the invention.

FIG. 2 is a front elevation view of the invention installed on a flooded system. In a flooded system liquid is present throughout the system. The operating fluid in such a system is typically ammonia ($NH_3$). Liquified ammonia enters the system from a compressor (not shown) into inlet 21. An inlet hand valve 22 (hand tube expansion valve) is typically present at this point. The inlet 23 of an evaporator coil 24 is attached to the other end of hand expansion valve 22. Partial evaporation of the liquid ammonia takes place in evaporator coil 24. With this evaporation, cooling occurs, which in turn cools air blown through coil 24 by fans 26 and 27. Liquid ammonia and ammonia gas exit via an outlet 28. A second hand expansion valve 29 is attached to outlet 28. The other end 31 of outlet expansion valve 29 returns to the compressor (not shown). Inlet 23 is provided with a well 32. A sensor 33 is situated in well 32 and is connected by a capillary 34 to the control box 36. A second sensor 37 is attached via a second capillary 38 to control box 36. Second sensor 38 is located in a well 39 located in outlet 28 of evaporator coil 24. Sensors 33 and 37 along with control box 36 allow monitoring the temperature differential between the inlet 23 and outlet 28 of evaporator coil 24. Monitoring of the temperature differential allows the system to be run at maximum efficiency by determining the degree of saturation in the evaporator coil 24. For ammonia flooded systems the ideal temperature differential would be 0°.

Figure 3:
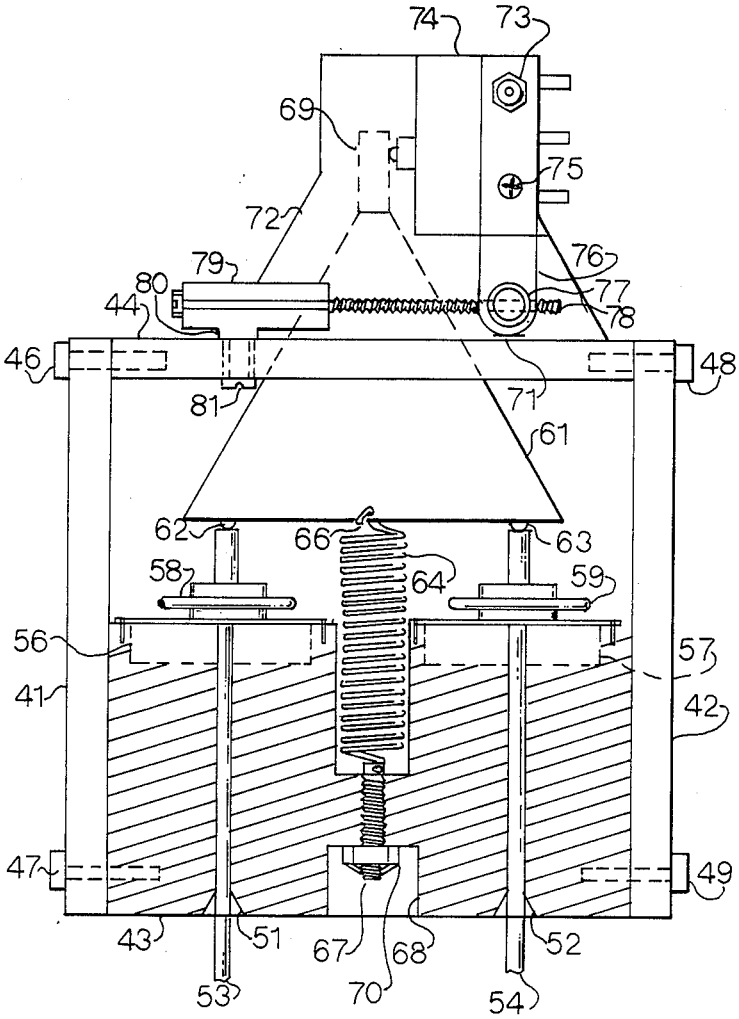
FIG. 3 is a front section elevation view of the controller of the invention.

FIG. 3 is a front section elevation view of the control box of the invention. A right side member 41 and left side member 42 are connected to a base 43 and a top 44 by screws 46, 47, 48 and 49. Base 43 is provided with orifices 51, 52 to allow passage of conduits 53 and 54 respectively. Conduit 53 is connected to a sensor in the vicinity of the outlet of the evaporator coil. Base 43 also provides mounting surface with reliefs 56 and 57 for diaphragms 58 and 59 respectively. Diaphragm 58 is connected to conduit 53 and diaphragm 59 is connected to conduit 54. Conduits 53 and 54 are typically fluid filled capillaries having a length of about 60 inches. Typical diaphragms 58 and 59 are designated as type A46 manufactured by Ranco or equivalent. Differential triangular floating beam 61 rests upon the tops 62 and 63 of diaphragm 58 and 59 respectively. A range set spring 64 is connected to beam 61 in a position 66 intermediate between top 62 and top 63. The other end of spring 64 is attached to a range set stud 67 mounted in a recess 68 in base 43. Adjustment of stud 67 varies the tension applied by spring 64. A locknut 70 fixes the adjustment of stud 67. An extension 69 is connected to one part of beam 61. extension 69 passes through a guide slot 71 in top 44. A bracket 72 is also attached to top 44. Mounting bracket 72 is provided with a pivot screw and nut 73. A microswitch 74 is rotatably attached via pivot 73 to mounting bracket 72. Extension 76 is connected to switch 74 by a screw 75. Extension 76 is provided with a threaded swivel collar 77 at the end opposite pivot shaft 73. A set point adjustment screw 78 is threadably attached to swivel collar 77. A hex stock 79 is attached to top plate 44 with spacer 80 and screw 81. A Honeywell (11SM401-T) microswitch with a 5 amp contact rating is used for microswitch 74 but it is realized that an equivalent could also be used. In freon applications a time delay relay is used to activate a solenoid valve in the coolant supply. The delay of the relay is adjustable from 1–60 seconds for use with different systems.

In operation the spring tension on screw 67 is adjusted so that beam 61 is in firm contact with tops 62 and 63 of the diaphragms 18, 19. The set point is adjusted by use of screw 78 for a variation of −8° to +8° F. with a typical setting of +−3° to +−4° F. Range of operation of the device is −25° to +40° F. The differential nature of the device prevents activation by variation of ambient temperature. If a flood back condition occurs the temperature at FIG. 1, point 11 will vary from that at FIG. 1, point 10 by more than the set point in the negative direction, i.e., too low of superheat. Refering now to FIG. 3 we see that this will cause beam 61 to tilt due to the different positions of tops 62 and 63 activating microswitch 74. Microswitch 74 can directly sound an alarm (not shown) or more often activate a time delay relay (not shown) which cuts off the supply of coolant to the evaporator coil. The supply of coolant is cut off for a period sufficient for the excess coolant to evaporate. This time period varies with the size and design of the evaporator coil but is typically between 1 and 60 seconds, usually between 8 and 25 seconds. After this time period the time delay relay reopens the supply of coolant. In an ammonia flooded system the device monitors operating conditions. Here the ideal temperature differential is 0°. In an alternative embodiment microswitch 74 can be replaced with a 4–20 mill. amp analog output which can be directly connected to a computor input.

Figure 4:
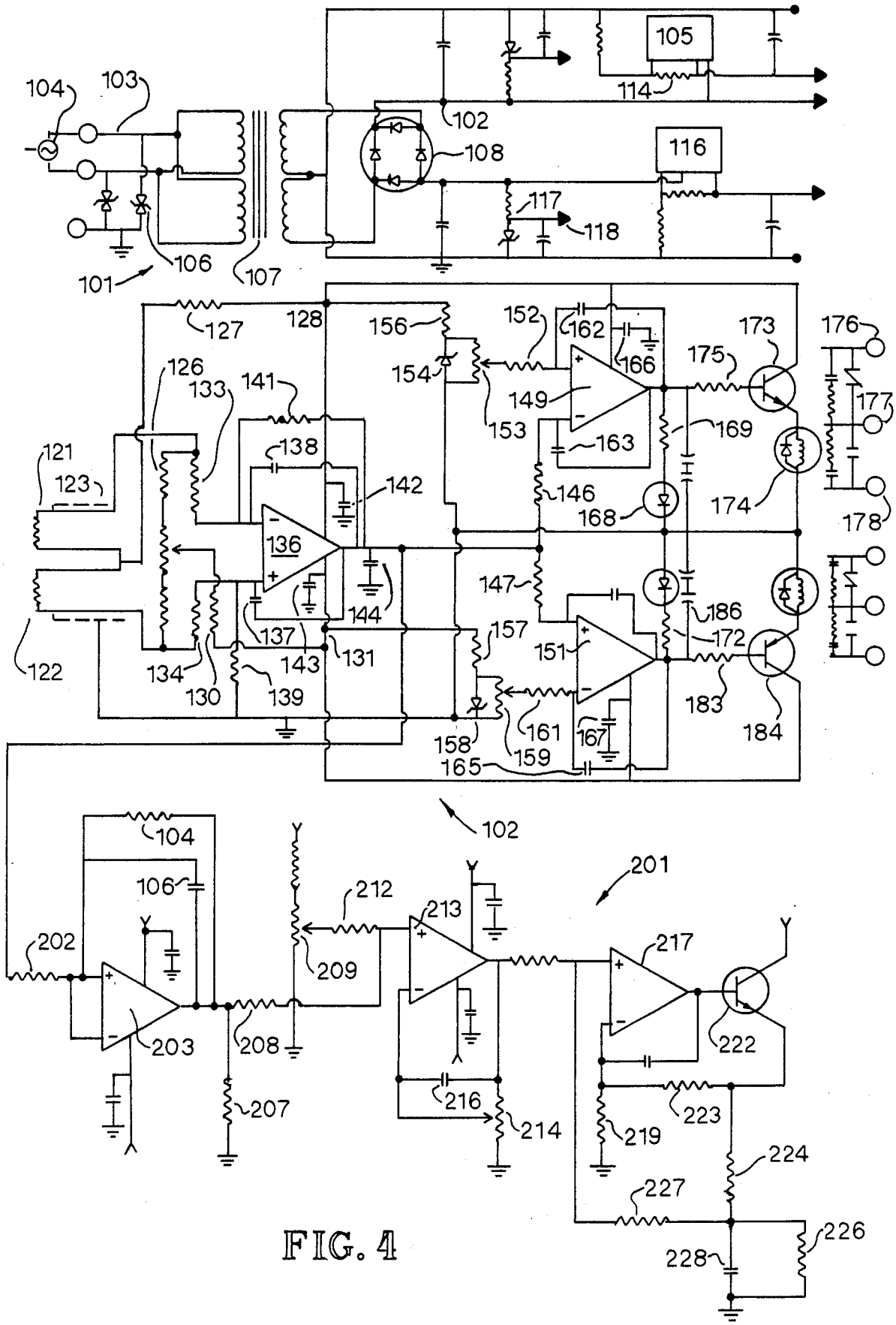
FIG. 4 is a schematic diagram of a third embodiment of the invention.

FIG. 4 is a schematic of a third embodiment of the invention. The components of FIG. 4 would be enclosed in control box 14 in either the FIG. 1 or 2 embodiments with conduits 13, 17 replaced by wires and sensors 12, 16 replaced with 100 ohm platinum RTO sensors, a temperature variable resistor. A suitable type of wire includes Belden 9502 cable although any equivalent can be substituted.

FIG. 4 includes the components in control box 14 which include a power supply 101 and an amplifier system 102. Power supply 102 includes a connection 103 to a source of ac power 104. A surge protector 106 prevents power surges from harming electronic components. A transformer 107 transforms the 120 vac power to 34 vac which is in turn converted to direct current by a bridge rectifier 108. A regulation circuit 105 is connected to bridge rectifier 108 to assure even voltage. A first capacitor 109 removes ripples from the dc. A resistor 111 zener diode 112 and a second capacitor 113 provide an 18 volt source. Regulator 105 can be a LM317T or equivalent with a 220 ohm resistor 114 and 1.5 k ohm resistor to provide regulated voltages of +9.6 and +26.5 volts. A second regulator 116 is also connected to bridge 108 to provide −9.6 volts. A second network 117 provides a negative voltage of 18 volts at point 18. It is recognized that an equivalent power supply could be substituted that provides proper voltages at an appropriate level of current.

Assembly 102 is the pre-amp dual alarm system of the invention. Power connections to the individual components have been eliminated for the sake of clarity in some cases. Platinum temperature resistive devices (RTD) 121, 122 having nominal values of 100 ohms at 32° F. are connected via a cable 123 to the control box. Cable 123 was a Belden 9502 shielded cable in the preferred embodiment but it is recognized that other equivalent cables could be substituted. Resistors 121 and 122 thus form two legs of a bridge circuit with two fixed value resistors 124, 126 having values of 95 ohms forming the other two legs of the bridge. The bridge is supplied with appropriate working voltages via a 3300 ohm resistor 127 connected to a source of 10 volt power at point 128. The slider of a 10 ohm variable resistor 129 connected to a negative source of 10 volts through another 3300 ohm resistor 130 at point 131 allows balancing of the bridge for initial setting. The bridge is connected through 500 ohm resistors 133, 134 to the inputs of a differential amplifier 136. A 1m741 integrated circuit was used for amplifier 136 in this embodiment but other equivalents could be substituted. The inputs are bypassed by small 120 pf. capacitors 138, 138 with the negative input connected to ground via a 3 megohm resistor 139 and the positive input connected to the output via another 3 megohm resistor 141 to provide negative feedback. Power is supplied for amplifier operation from points 128 and 131 which are bypassed by capacitors 142 and 143 having values of 0.1 mf. The output of amplifier 136 is also bypassed by a 0.1 mf. capacitor 144. This completes the pre-amp section of the circuitry.

The output of the pre-amp is connected via 1000 ohm resistors 146, 147 to the − input of a hi alarm amplifier 149 and the + input of a low alarm amplifier 151. Amplifiers 149 and 141 are sections of an integrated circuit sold as a lm 1458 in this embodiment. A hi set reference voltage is applied to the + input of amplifier 149 via a 1000 ohm resistor 152 connected to the slider of a lOk ohm potentiometer 153 connected across a zener diode 154 connected to ground and point 128 via a 4.7 k ohm resistor 156. Adjustment of potentiometer 153 sets the hi alarm level. A similar network consisting of a 4.7 k ohm resistor 157, zener diode 158, 10k potentiometer 159, and 1000 ohm resistor connected to the − input of amplifier 151 sets the low alarm. All inputs are bypassed to the outputs by 120 pf capacitors 162, 163, 164, and 165 to prevent oscillation. Amplifiers 149 and 151 are supplied with operating power from points 128 and 131 respectively with the power connection bypassed by 0.1 mf capacitors 166 and 167. The output of hi alarm amplifier 149 is connected to a light emitting diode 168 via a 1000 ohm resistor 169 to give a visual alarm of its operation. Similarly, the output of low alarm amplifier 151 is connected to a second LED 171 via a 1000 ohm resistor 172 to give visual notification of the alarm state. The output of hi alarm amplifier 149 is also connected to the base of a transistor 173 via a 1000 ohm resistor 175. Transistor 173 is a 2N2222 in this embodiment but substitutuion of equivalents is possible. The collector of transistor 173 is connected to point 128 to provide power and the emitter has the coil of a relay 174 as a load. Relay 174 includes contacts 176, 177, 178 having 10 amp ratings which can be used to switch on or off the equipment being protected. The base of transistor 173 is bypassed to ground by two back to back 220 mf. capacitors 181 in the non polarized configuration. Similarly, the output of low alarm amplifier 151 is connected via a 1000 ohm resistor 183 to the base of a transistor 184 bypassed by two 220 mf capacitors in a non polarized configuration 186. In this case the preferred embodiment uses a 2N2907 for transistor 184 with the collector connected to point 131 and the emitter having a relay 187 as a load. Relay 187 includes contacts 188, 189 and 191 which are rated at 10 amps. In operation, a temperature differential in excess of predetermined limits will unbalance the bridge creating a signal at the output of amplifier 136 which will in turn either activate alarm amplifier 149 or 151 dependent upon its polarity. Amplifiers 149 or 151 will light their respective LED 168 or 171 and throw the appropriate relay 174 or 187. This completes the description of the pre-amp dual alarm circuitry.

For some applications it is desirable to have a variable voltage as an output which can be used to control a microprocessor or computer. The converter circuitry 201 performs this function. A signal is obtained from the output of pre-amp 136 and applied through a 10k ohm resistor to the inputs of an amplifier 203. Amplifier 203 is a section of an integrated circuit sold as a 1m741. Negative feedback is provided by a resistor 204 having a value of 10k ohms connected between the input and output. A 120 pf capacitor 206 prevents oscillation. A voltage divider consisting of a 15k ohm resistor 207 and a 10k ohm resistor 208 accepts the output of amplifier 203. A zero adjustment is provided by a potentiometer 209 connected to ground and a source of 10 volts through a 15k ohm resistor 211. The slider of potentiometer 209 is connected via a 10k ohm resistor 212 to the output of the voltage divider and the + input of the zero-span amplifier 213. In this embodiment amplifier 213 is a section of a 1m1458 integrated circuit with the − input connected to ground via a 10k ohm potentiometer 214 slider. Potentiometer 214 is the span adjustment and is connected to ground and the output of amplifier 213. A 120 pf capacitor 216 prevents oscillation. The output of amplifier 213 is connected to another amplifiers + input 217 via a 100k ohm resistor 218. Amplifier 217 is another section of the 1m1458 integrated circuit in this embodiment. The − output of amplifier 217 is connected to ground via a 100k ohm resistor 219 and bypassed to the output by a 120 pf capacitor 221. The output of amplifier 217 is connected to the base of a transistor 222. In this embodiment transistor 222 is a 2N3053 with the collector connected to +26.5 volts at the power supply. The emitter of transistor is connected to the − input of amplifier 217 via a 100k ohm resistor 223 and the load via a 250 ohm resistor 224. The load 226 is connected between ground and resistor 224. A 100k ohm resistor 227 provides feedback to the + input of amplifier 217. A 0.01 mf capacitor 228 short circuits any transients produced by the load. This circuit provides a 1 to 5 volt process variable output into a 10k ohm minimum load across resistor 224 and a 4 to 20 MA process variable output across the load 226 maximum 575 ohms dependent upon the temperature differential between the sensors.

The embodiments shown are exemplary only the invention being defined by the claims herein.

I claim:

1. An apparatus for detecting differential temperatures in a refrigeration system which includes at least one evaporator comprising:

a power supply connectable to a source of electric current for providing appropriate voltages for all components; and, a first sensor connected to one side of the evaporator of the said refrigeration system; and, a second sensor connected to the other side of the evaporator of the said refrigeration system; and, a bridge circuit connected to said first sensor and said second sensor and said power supply for producing an electrical current when there is a temperature differential between said first sensor and saad second sensor; and, a differential amplifier connected to said bridge circuit and said power supply for increasing the current produced by said bridge circuit; and, further amplification means connected to said differential amplifier for furhter increasing the strength of said current produced by said differential amplifier; and, an output connected to said further amplification means including a light emitting device and a relay; and, a transistor connnected to saad power supply said further amplication means and said relay for activating said relay; and, additional further amplication means connected to said differential amplifier and said power supply for further increasing the magnitude of the output of said differential amplifier; and, zeroing means connected to said further amplification means for creating a baseline state; and, span adjustment means connected to said further amplification means for adjusting the span of the output of said further amplification means; and, signal forming means connected to said further amplification means to a condition readable by a microprocessor and computer.

* * * * *